US005239923A

United States Patent [19]

Belcher et al.

[11] Patent Number: 5,239,923

[45] Date of Patent: Aug. 31, 1993

[54] SCREEN PRINTER

[75] Inventors: James E. Belcher, Belding; John R. Coulter, Grand Rapids, both of Mich.

[73] Assignee: Harco Graphic Products, Inc., Grand Rapids, Mich.

[21] Appl. No.: 845,997

[22] Filed: Mar. 1, 1992

[51] Int. Cl.[5] ..... B05C 17/04

[52] U.S. Cl. ..... 101/123; 101/115

[58] Field of Search ..... 101/114, 123, 124, 126, 101/129, 127.1, 128, 128.1, 115

[56] References Cited

U.S. PATENT DOCUMENTS

| | | | |
|---|---|---|---|
| Re. 29,160 | 3/1977 | Jaffa | 101/123 |
| 1,495,037 | 5/1924 | Patterson | 101/126 |
| 2,690,118 | 9/1954 | Schwartz et al. | 101/115 |
| 2,704,510 | 3/1955 | Walsh, Jr. | 101/123 |
| 2,739,530 | 3/1956 | McLaurin | 101/123 |
| 2,793,586 | 5/1957 | Arelt | 101/123 |
| 2,845,859 | 8/1958 | Gattuso | 101/126 |
| 2,991,711 | 7/1961 | Ehrhard et al. | 101/126 |
| 3,359,895 | 12/1967 | Forslund | 101/123 |
| 3,467,004 | 9/1969 | Best et al. | 101/35 |
| 3,492,942 | 2/1970 | Forslund | 101/123 |
| 3,541,954 | 11/1970 | Speicher et al. | 101/29 X |
| 3,685,085 | 8/1972 | Jaffa | 101/114 |
| 3,780,652 | 12/1973 | Black et al. | 101/124 |
| 3,828,671 | 8/1974 | Fuchs | 101/123 |
| 3,885,493 | 5/1975 | Jaffa | 101/123 |
| 3,930,445 | 1/1976 | Jaffa | 101/120 |
| 4,031,825 | 6/1977 | Jaffa | 101/126 |
| 4,078,485 | 3/1978 | Guthrie | 400/225 |
| 4,088,215 | 5/1978 | Bader | 400/59 |
| 4,090,443 | 5/1978 | Gasser | 101/123 |
| 4,099,460 | 7/1978 | Bubley et al. | 101/44 |
| 4,254,708 | 3/1991 | Bubley et al. | 101/123 |
| 4,276,826 | 7/1981 | Bubley et al. | 101/123 |
| 4,315,461 | 2/1982 | Harpold | 101/115 |
| 4,389,936 | 6/1983 | Jaffa et al. | 101/123 |
| 4,407,195 | 10/1983 | Jaffa | 101/123 |
| 4,414,559 | 11/1983 | Bubley | 101/123 |
| 4,537,126 | 8/1985 | Bubley | 101/123 |
| 4,606,268 | 8/1986 | Jaffa | 101/115 |
| 4,696,228 | 9/1987 | David et al. | 101/123 |
| 4,722,621 | 2/1988 | Johnson | 400/86 |
| 4,735,139 | 4/1988 | Szarka | 101/126 |
| 4,817,523 | 4/1989 | Harpold et al. | 101/123 |
| 4,841,831 | 6/1989 | Bender et al. | 74/813 R X |
| 4,920,878 | 5/1990 | Harpold et al. | 101/115 |
| 4,938,130 | 7/1990 | Thorpe | 101/126 |
| 4,972,773 | 11/1990 | Barlow | 101/128.1 X |
| 5,048,417 | 9/1991 | Everroad | 101/126 X |

FOREIGN PATENT DOCUMENTS

| | | | |
|---|---|---|---|
| 3207403 | 8/1983 | Fed. Rep. of Germany . | |
| 6044348 | 8/1983 | Japan . | |
| 1498267 | 1/1978 | United Kingdom | 101/123 |

OTHER PUBLICATIONS

Product brochure of Printing Equipment, published by Antec Inc., Charlottesville, VA, publication date unknown.

*Primary Examiner*—Edgar S. Burr

*Assistant Examiner*—Ren Yan

*Attorney, Agent, or Firm*—Price, Heneveld, Cooper, Dewitt & Litton

[57] ABSTRACT

A multi-station screen printer is provided with components which simplify maintenance, reduce repair and increase ease of use. The printer includes at least one printing head which defines a printing station, a screen holding device positioned thereunder for holding a screen, and at least one arm for carrying substrates positionable below the screen holding device. A flood bar and squeegee carriage is slideably mounted to the printing head and is shiftable by a telescoping cable which shifts the carriage between a print position wherein the squeegee is lowered to the screen and a non-print position wherein a flood bar is lowered near the screen. The arm for carrying platens is provided with a ball and socket system of registration which reliably positions the arm at each station and releases the arm therefrom after printing on the substrate. A carriage position sensing circuit utilizes a potentiometer to sense the translational position of the carriage and also utilizes control limit pots to provide dial-adjustment of stop points, thus eliminating limit switches and providing increased ease of use. Further, the printing head and also the screen holding device are pivotally mounted to the printer main frame between a lowered position maintained during normal press operation, and a raised position which is used to facilitate cleaning, maintenance, and setup.

40 Claims, 11 Drawing Sheets

SCREEN PRINTER

BACKGROUND OF THE INVENTION

The present invention relates to a screen printing apparatus and more particularly to improvements in a screen printer for simultaneously performing multiple printing operations in a continuous manner.

Screen printing is a relatively well-known process wherein ink is pressed through small holes in a screen to print designs on a substrate. Typically, ink is spread on a screen by a flood bar, and forced through the screen in small quantities by a squeegee. Modern improvements include mounting the flood bar and squeegee on a translatable carriage which shifts the flood bar and squeegee between print and non-print positions, and then sequentially translates across the screen after each shift. In the non-print sequence, the flood bar is lowered and is carried across the screen to spread the ink. In the print sequence, the squeegee is lowered and moved across the screen to print the ink.

Automatic screen printing presses are presently available for simultaneously printing at multiple stations such as for printing multiple colors. The presses move a plurality of substrate carrying platens stepwise around a main frame in a circle or oval path. Traditionally the platens move in a horizontal plane and sequentially under a plurality of printing heads, the heads defining individual stations. As the platens are stopped under each printing head, a screen and printing head first move vertically down onto individual platens to print and then up to a raised position via four corner cylinders, the screen and head poised for the next cycle. Alternatively in a separate press design, the printing heads pivot as they are raised up and down in a flat bed press, most typically all printing heads moving simultaneously. Examples of such machines are illustrated in: U.S. Patent No. Re. 29,160 issued Mar. 29, 1977 to Jaffa, and entitled: SCREEN PRINTING MACHINE WITH OVAL RAIL FOR INDEXING PALLETS and U.S. Pat. No. 4,407,195 issued Oct. 4, 1983 to Jaffa, and entitled SCREEN PRINTING MACHINE.

A revolutionary improvement was made in screen printers wherein the printing heads were held stationary while the platens pivot. An example of such a machine is illustrated in: U.S. Pat. No. 4,920,878 issued May 1, 1990 to Harpold et al, and entitled SCREEN PRINTER WITH PLATEN LIFTING STRUCTURE the entire contents of which are incorporated by reference. In these machines, one or more platens supporting articles to be printed are driven along a track, the platens moving laterally in a circle or ovally around a main frame or base. The platens are then laterally stopped and vertically lifted to a print position under stationary printing heads.

However, this improved screen printer as well as the other style continue to present further opportunity for improvement. For one, screen printing presses utilize air and hydraulic cylinders for lifting and other mechanical movements. These cylinders and the hydraulic or pneumatic systems which actuate them are expensive. Also, if not taken care of properly, these systems are subject to a variety of problems such as dirty oil or air, a frequent problem of poor maintenance which causes press malfunctions and downtime. Further, these cylinders and actuator systems are cumbersome and can be difficult to work with and around. Also, air cylinders are subject to 'bounce' at the end of cylinder strokes.

Some mechanisms for replacing cylinders have been designed for shifting the flood bar and print squeegee on the carriage such as chain and sprocket mechanisms. However, these mechanisms are often cumbersome and mechanically complex. Further, the mechanisms can be difficult to work around and add expense to the screen printer. Also, they often require continuous maintenance such as lubricating. Further, the position of cylinders are usually detected and controlled by use of limit switches. However, the limit switches are inconvenient to adjust.

The present machines utilizing pivoting platens include a platen registration system which has a pair of elongated indexing assemblies that cooperate to locate individual platens with respect to the screen and printing head at each station. The registration system is illustrated in: U.S. Pat. No. 4,920,878 issued May 1, 1990 to Harpold et al, and entitled SCREEN PRINTER WITH PLATEN LIFTING STRUCTURE. However, the elongated indexing assemblies may hang up in the raised print position if not properly adjusted and maintained. This can cause press downtime and disrupt the printing process.

Another problem is that the print screens periodically need to be cleaned or inspected, or the substrate being printed on needs to be visually inspected. In a fixed head machine, and also in machines wherein the printing head is vertically lifted or tilted, cleaning or inspecting of the screen or substrate can be difficult due to the lack of space between the screen, the platen (i.e. substrate) and the printing head. Compounding this problem is the fact that operators do not want to remove the screen because then the screen must be realigned.

In presses which include a pivoting type head, the bottom of the screen is only partially accessible when the screen is up. Further the mechanism for raising and lowering the head is cumbersome since the mechanism is ruggedly designed to be a part of the printing cycle.

Thus, further improvements are desired in simplicity, cost, reliability, ease of adjustment, and flexibility of use.

SUMMARY OF THE INVENTION

One aspect of the present invention is directed to a printing press that includes a cable operably connected between a remote motor and a shifting means located on a translatable carriage, the cable adapted to shift the carriage between print and flood positions.

Another aspect of the present invention is directed to a registration system for a printing press. The printing press includes a first register plate mounted to a frame and a second register plate mounted to a movable arm for carrying substrates, the first and second register plates including first and second locating members forming a ball and socket arrangement to repeatably locate the moveable arm at stations on the printing press.

Another aspect of the present invention is directed to a carriage position sensing system for a printing press which includes a potentiometer for sensing the position of the squeegee and flood bar carriage, the potentiometer cooperating with the means for moving the carriage to controllably locate the carriage.

The present invention is further directed to a printing press which includes a printing head for printing ink through a screen, the printing head being pivotally moveable between a lowered position which is consistently maintained during normal operation of the printing press, and a raised position which is used for cleaning the screen and for press maintenance and setup.

The present invention is further directed to a printing press which includes a normally fixed but pivotally mounted screen holding device for holding a screen. The holding device is pivotally mounted to the press and is moveable between a lowered position which is consistently maintained during normal operation of the printing press, and a raised position which is used for cleaning the screen and for press maintenance and setup.

BRIEF DESCRIPTION OF THE DRAWINGS

This invention, its function and operation will be further explained by the following description with reference to the drawings and claims in which:

DETAILED DESCRIPTION OF THE PREFERRED EMBODIMENT

Figure 1:
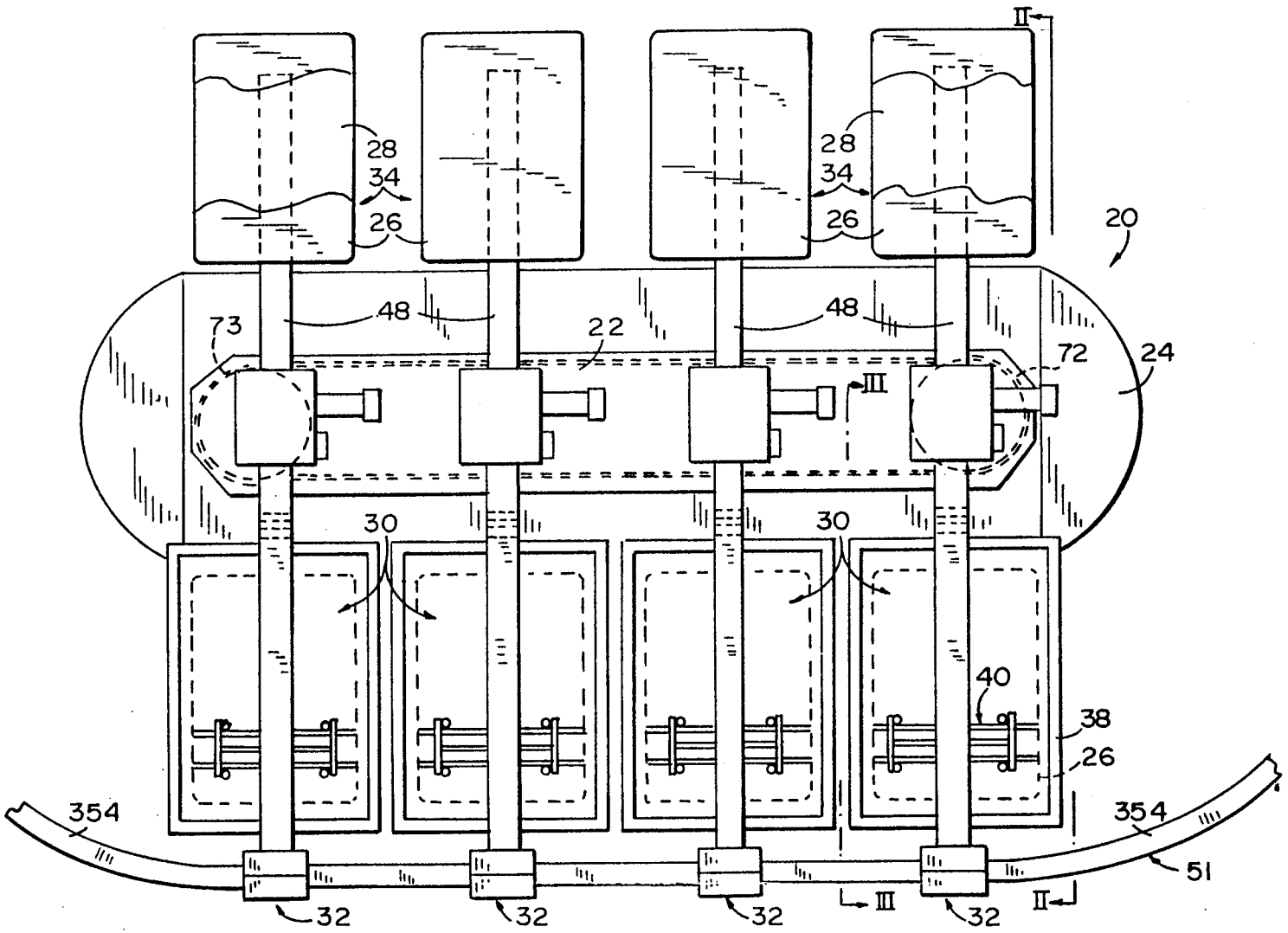
FIG. 1 is a top plan view of a multi-station screen printing press embodying the present invention.

A screen printer 20 of the preferred embodiment is shown in FIGS. 1-5 and includes a main frame 22 (FIGS. 1 and 2) which provides an oval track 24 upon which platens 26 carrying substrates 28 are movably supported. Printer 20 has four printing heads 30 which define printing stations 32 on one side and four load/unload stations 34 on the other side, though more or less stations can be used. Platens 26 are carried laterally by elongated arms 48 from station to station in a lowered position (FIG. 3), and are stopped at each station 32 so that they can be pivotally swung upwardly into a registered print position (FIG. 2) as will be described below.

Figure 2:
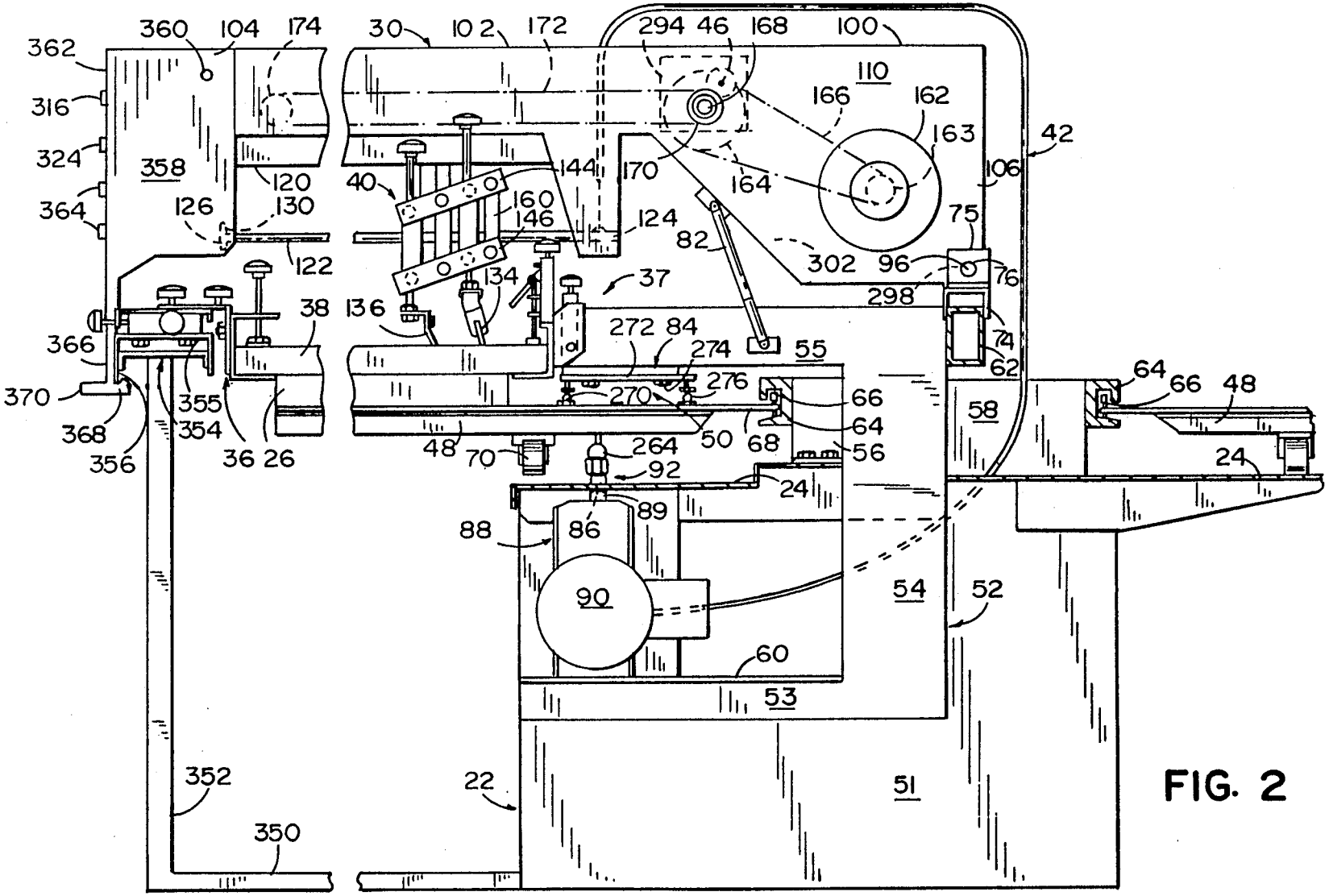
FIG. 2 is a cross-sectional view of a printing station taken along the plane II—II in FIG. 1, the arm and platen being raised in a print-ready position.

Main frame 22 (FIGS. 1 and 2) is located generally supportingly underneath printing heads 30 and includes a main support portion 51, the specific construction of which is unimportant except as noted. Mounted on support portion 51 at each printing station 32 are "C" shaped structural subframes 52 each of which include a lower horizontal beam 53, a vertical beam 54, and an upper horizontal beam 55. Beams 53, 54, and 55 are rigidly interconnected to form subframe 52 so that a lifting mechanism 88 for raising arms 48 can be operably placed between horizontal beams 53 and 55 on shelves 60. Subframes 52 are constructed to absorb the opposing stresses created by lifting mechanisms 88 as they raise elongated arms 48 from a lowered preprint position (FIG. 3) to a registered print position (FIG. 2).

Guideway 64 (FIG. 2) extends generally horizontally and is supported by guideway support structures 56 and 58 mounted to main frame 22 above track 24. Guideway 64 is substantially "C" shaped and carries endless chain 66 therein. Chain 66 cooperates with track 24 and elongated arms 48 to lateral move platens 26 as disclosed in U.S. Pat. No. 4,920,878, issued May 1, 1990, entitled SCREEN PRINTER WITH PLATEN LIFTING STRUCTURE. Briefly described, the inner end 68 of elongated arm 48 is pivotally attached to endless chain 66 and is directed by guideway 64 around main frame 22. A roller 70 located on the underside of elongated arm 48 contacts and rides on oval track 24 thereby providing substantially frictionless lateral movement. Drive means 72 (FIG. 1) drives endless chain 66 (and, in turn, arms 48, platens 26, and substrates 28) sequentially around oval track 24. Switches (not shown) attached to drive means 72 are operably connected to stop drive means 72 and in turn arms 48 as platens 26 arrive at each printing station 32. Idler wheel or sprocket 73, located at the opposite end of printer 20 from drive means 72, cooperates with drive means 72 and guideway 64 to guide endless chain 66 around printer 20.

Upper horizontal beam 55 (FIG. 2) is spaced above track 24 and provides structural support for individual printing heads 30 and screen holding device 37. Affixed to the rear of beam 55 and to the upper rear of subframe 52 is a laterally extending beam 62 which extends along the lateral length of printer 20. Upstanding brackets 74 and 75 are attached to the top of beam 62. Holes 76 located in bracket 75 provide a pivot hinge for pivotal attachment of printing head 30 to beam 62. Lift assists are provided to assist in lifting printing heads 30 such as for press setup and maintenance. It is contemplated that the lift assists could be of any of a number of designs utilizing springs, counter balance weights, powered assists or the like. In the preferred embodiment, gas struts 82 are used as lift assists and are generally vertically mounted between printing head 30 and horizontally extending beam 55.

Figure 6:
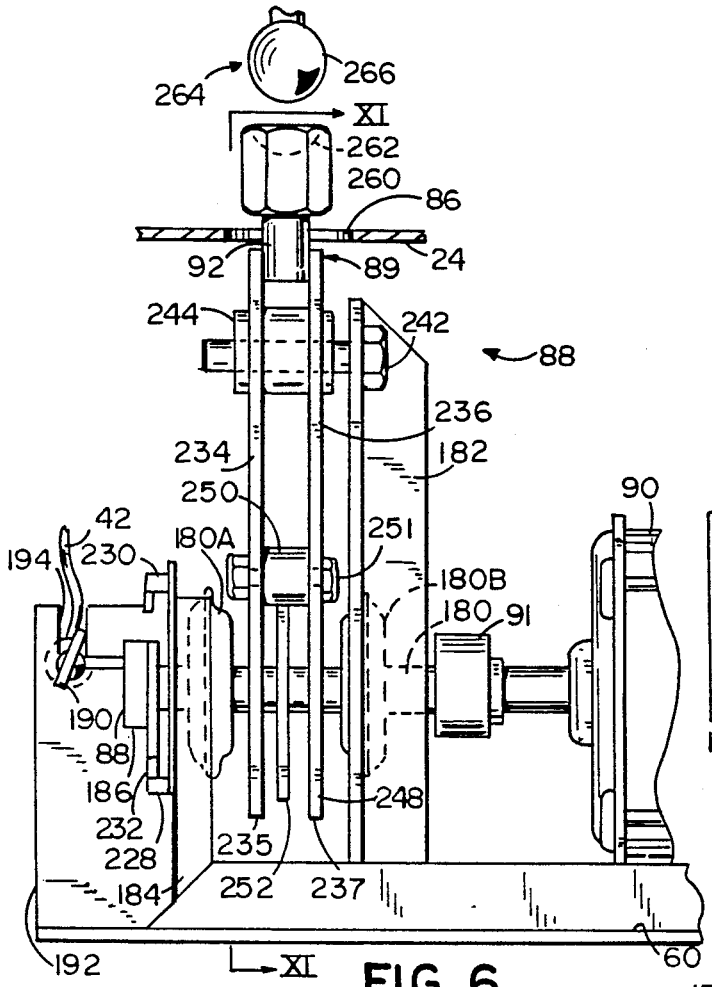
FIG. 6 is a side view of the actuating mechanism for the cable shift system and the platen lift mechanism.
Figure 10:
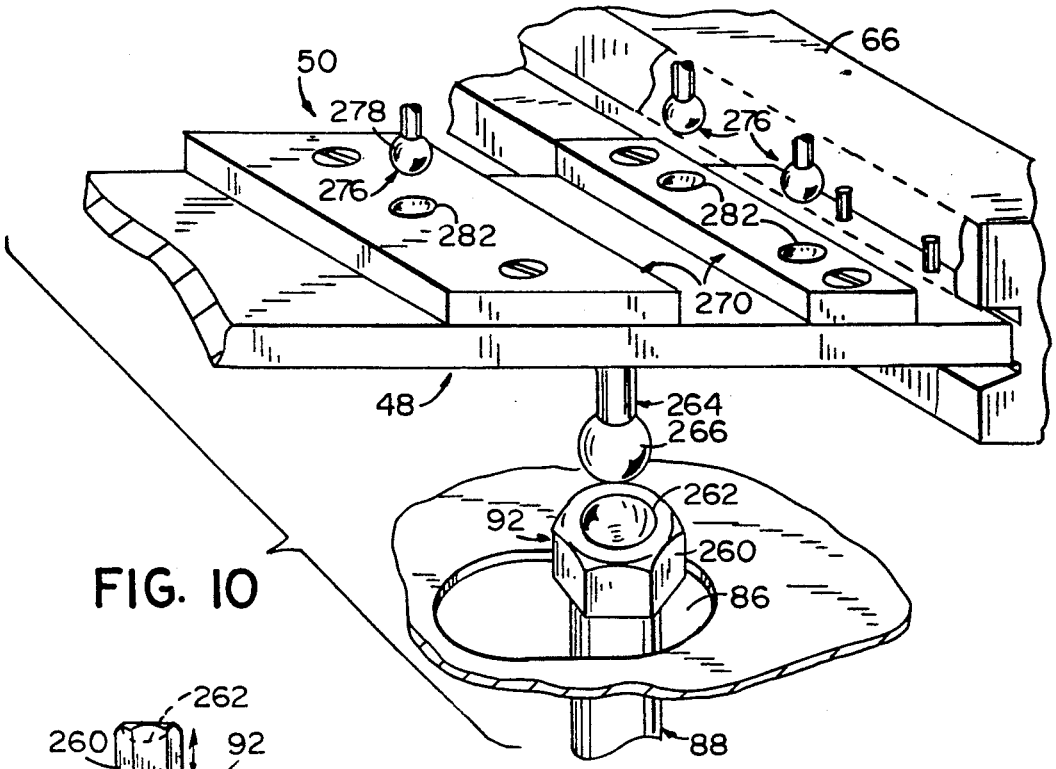
FIG. 10 is an enlarged fragmentary perspective view of the registration system for a printing station.

Oval track 24 extends around main frame 22 (FIGS. 1 and 2), and is positioned below guideway 64 on main support portion 51. As noted, oval track 24 provides a substantially flat surface upon which rollers 70, of elongated platen carrying arms 48 laterally move. Oval track 24 includes an opening 86 (FIGS. 2, 6 and 10) at each station 32 through which uplifting member 92 extends.

Each lift mechanism 88 (FIG. 6) includes a lift carriage 89 which rides up and down on cam 252, thus lifting platen carrying arm 48 sequentially upwardly into a registered print position (FIG. 2) and then releasingly back downwardly into a preprint position (FIG. 3) where arms 48 and platens 26 are ready to be laterally moved to the next print station 32. Lift mechanism 88 (FIG. 6) is driven by a motor 90 which attaches to shaft 180 through universal joint 91. Shaft 180 is supported by bearings 180A, 180B mounted in upstanding bearing stands 182, 184, bearing stand 182 being taller and nearer to motor 90 and bearing stand 184 being somewhat shorter and also positioned farther from motor 90. A cam 252 is rotatably fixedly mounted on shaft 180 between bearing stands 182, 184. Near the top of tall bearing stand 182 is a laterally extending bolt or peg 242. Peg 242 is fixedly secured to stand 182 and positioned to guide side members 234 and 236 vertically as described below.

Figure 11:
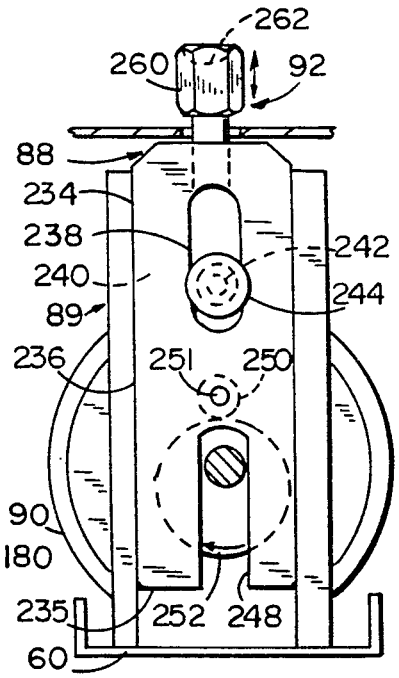
FIG. 11 is a cross-sectional view of the lift mechanism as taken along the plane XI—XI in FIG. 6.

Lift carriage 89 (FIGS. 6 and 11) is comprised of two downwardly extending side members 234 and 236 having lower ends 235 and 237, respectively. Side members 234, 236 are fastened to either side of uplifting head member 92, include upper slots 238, 240, respectively (FIG. 11), so that peg 242 can be received therein. Since peg 242 is fixed, it acts to guide side members 234, 236 up and down, limiting their lateral movement. A bearing 244 is placed on peg 242 so as to slideably mount side members 234, 236 to stand 182. However, due to the elongated nature of slots 238, 240, lift carriage 89 is permitted to move vertically. Tolerances built into this arrangement allow some non-vertical movement in lift carriage 89 so that uplifting member 92 can adjust to the path of movement of arm 48 as member 92 moves arm 48 upwardly.

A follower 250 (FIGS. 6 and 11) is rotationally mounted on an axle 251 between side members 234, 236 above lift cam 252. As cam 252 rotates, follower 250 follows the outer surface of cam 252 and moves lift carriage 89 up and down. Follower 250 is restricted to vertical movement over cam 252 by lift carriage 89 acting on peg 242 and shaft 180. The outer surface of cam 252 is designed to provide the desired distance of lift desired as shaft 180 is rotated.

Figure 7:
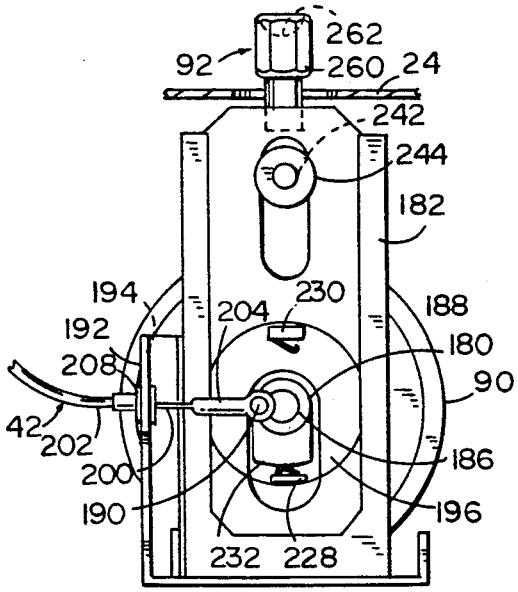
FIG. 7 is an end view of the actuating mechanism in FIG. 6.

Attached to the upper end of member 92 (FIGS. 6 and 7) is a contact head 260 which includes an upwardly facing depression 262. Depression 262 cooperates with a downwardly extending pin 264 on elongated arm 48. Pin 264 includes a ball-shaped head 266 which mateably engages depression 262 in a ball and seat arrangement. The interaction of ball-shaped head 266 and depression 262 allows contact head 260 to capture and vertically lift elongated arm 48. Depression 262 is cup-shaped to allow some lateral movement as pin 264 (and arm 48) is lifted upwardly into the print position.

Registration system 50 (FIGS. 2, 3 and 10) is located above elongated arm 48 and between arm 48 and horizontal beam 55. Registration system 50 includes an upper register plate 84 (FIG. 2) mounted underneath horizontal beam 55 and at least one lower register plate or portion 270 mounted on the upper side of elongated arm 48. Upper register plate 84 is comprised of a mounting plate 272 adjustably secured by bolts 274 to the underside of horizontal beam 55. Register plate 84 includes three downwardly extending locating pins 276 arranged in a triangular arrangement, each of pins 276 having a ball-shaped head 278. The lower register plates or portions 270 (FIG. 10) include three depressions or recesses 282 in a triangular arrangement. Depressions 282 mateably engage ball-shaped heads 278, thus providing a three point registration system for securely and repeatedly locating arm 48 with respect to printing head 30. Depressions 282 are cup-shaped with ramped sides to receive and guide ball-shaped heads 278 into the central portion of depressions 282. Ball-shaped heads 278 and depression 282 are designed such that they releasably engage and do not tend to bind or stick as they are released from the engaged position.

Figure 3:
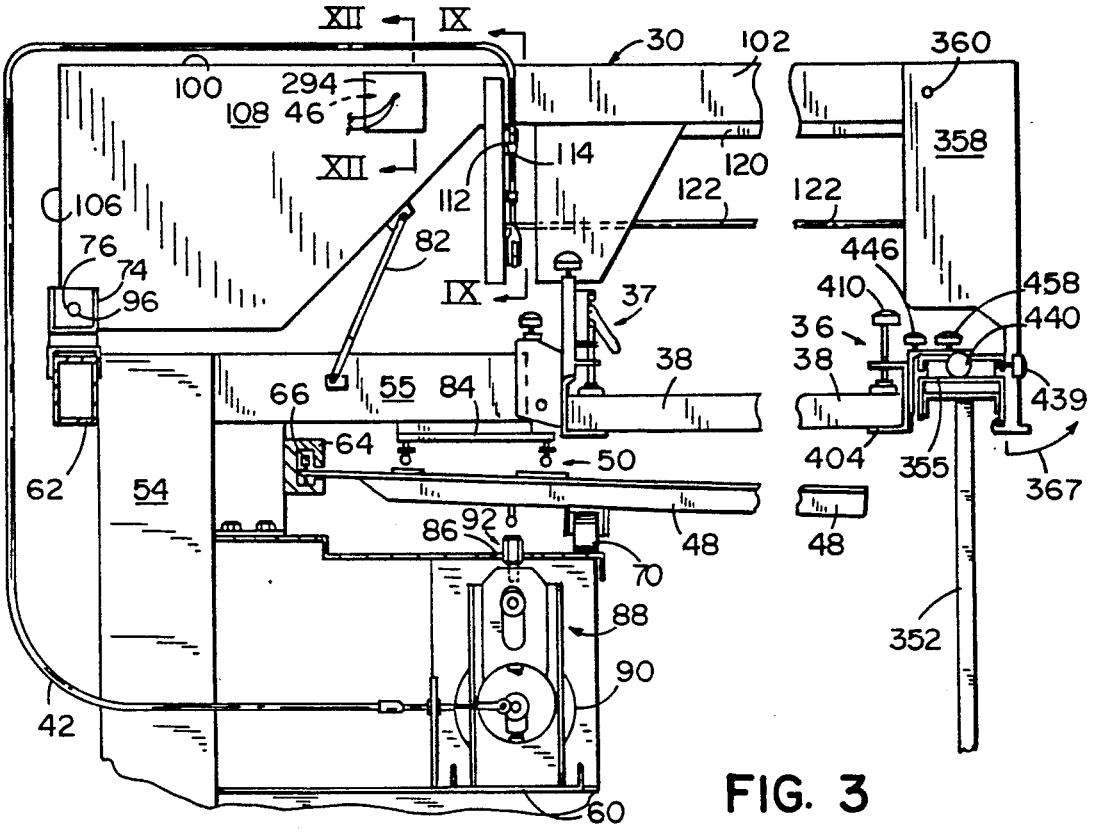
FIG. 3 is an elevational view of a printing station shown partially in section as taken along the plane III—III in FIG. 1, the arm and platen being lowered in a preprint position.

With platen 26 in a horizontal preprint position at print station 32, motor 90 (FIG. 11) rotates 180° causing lift cam 252 to rotate 180°. As lift cam 252 rotates, follower 250 is raised a predetermined distance thus lifting lift carriage 89 and member 92. Uplifting member 92 (FIG. 10) contacts and lifts arm 48 causing the depressions 282 of lower register plate 270 to engage the locating pins of upper register plate 84, thus forcing arm 48 into a print position (FIG. 2). After printing, motor means 90 rotates an additional 180° to the start position. When this happens, cam 252 lowers follower 250, lift: carriage 89, and arm 48 thereby releasing the registration system 50. Thus, arm 48 is lowered back to the preprint position (FIG. 3).

The registration system further includes a system of switches (FIG. 7) to cycle motor 90 on and off every 180° of rotation. Attached to bearing stand 184 are opposed switches 228 and 230. A trip cam 232 attached to shaft 180 is designed to trip either switch 228 or 230 every 180° of rotation. Switches 228, 230 are wired to the control circuit of press 20 such that motor 90 is stopped every 180° of rotation.

Printing head 30 (FIG. 2) includes an inner end 100 which attaches to main frame 22, an elongated central portion 102 which radially extends outwardly from inner end 100 in cantilever fashion, and outer end 104 which hangs downwardly from central portion 102. Inner end 100 includes a downwardly extending box-like structure 106 with sides 108 (FIG. 4) and 110 (FIG. 2). Inner end 100 of printing head 30 includes hinge pivot holes 298 which cooperate with holes 76 in bracket 74 and pivot hinge pin 96 to provide pivotal attachment of printing head 30 to main frame 22 (FIG. 2). Gas struts 82 pivotally attach to either side 108, 110 of inner end 100 and at a lower end to either side of beam 55. Gas struts 82 cooperate with horizontal beam 55 to support a significant portion of the cantilevered weight of printing head 30.

A subframe (FIGS. 1 and 2) extends at least partially around the perimeter of frame 51 and includes laterally extending supports 350 and vertical supports 352 rigidly interconnected to support a horizontal railing 354. Horizontal railing 354 (FIG. 1) extends around at least a portion of and is spaced outwardly from the perimeter of frame 51. Horizontal railing 354 includes an inverted U-shaped structural channel 355 (FIG. 2) that includes an outer downwardly extending web 356. Outer end 104 of printing head 30 includes a downwardly draping, pivotally mounted box-like member 358 which is pivotally mounted at pivot pin 360. Box-like member 358 includes a substantially planar outer wall 362 that is optimally used as a station control panel including multiple controls 364, 316 and 324 such as are used to control the power, movement and position of carriage 40, print squeegee 134, and flood bar 136. A latching member 366 extends downwardly from box-like member 358 and includes a hook 368 that engages web 356 to securely hold printing head 30 in a downward print-ready position. A handle 370 on latching member 366 can be gripped and pulled downwardly and outwardly as shown by the arrow 367 (FIG. 3) to pivot box-like member 358 on pivot pin 360, thus releasing hook 368 from web 356. Thereafter, printing head 30 can be pivotally lifted out of the way with the assistance of gas struts 82. By reversing the above noted procedure, printing head 30 can be re-latched in the downward print-ready position. Printing head 30 is, of course, normally held in the lowered, print-ready position. When an operator desires to expose screen 38, printing head 30 is released and moved out of the way. Also, screen 38 can then be more easily cleaned. When done, printing head 30 is re-engaged in the lowered, print-ready position as shown in FIG. 2 and 3.

A screen holding device including screen holding device 36 and 37 (FIGS. 3, 5, 15–19) is constructed to securely hold a screen 38 at each printing station 32. Screen holding devices 36 and 37 cooperate to allow fine adjustment of the spacial position of screen 38 with respect to each printing station 32, and also allow screen 38 to be pivoted upwardly to a position allowing greater visual access to substrates 28 which have been printed upon before substrates 28 leave printing stations 32. The upwardly pivoting of screen 38 also allows increased ease of maintenance such as for cleaning screens 38 at each printing station 32.

Inside screen holding device 37 (FIGS. 17–19) includes an L-shaped bracket 372 including a lower flange 374 adapted to vertically support an edge of screen 38. Mounted to the back side of L-shaped bracket 372 is a pivotal support bracket 376 with a pivot hole 378. A pivot pin 380 extends horizontally through pivot hole 378 into a vertical adjustment mechanism 382 that is securely mounted to the lateral outer end of beam 55 on each end of horizontal cross-beam 383. Each adjustment mechanism 382 includes hand grips 384 and locking nuts 386 that permit vertical adjustment and locking of the position of L-shaped bracket 372 and thus, in turn, provide for the vertical positioning of the inner end of screen 38 relative to printing head 30. Two or more toggle clamps 388 are securely fastened to bracketry 389 above L-shaped bracket 372 and correspondingly above lower flange 374. Toggle clamps 388 include a handle 390 and an adjustable stem 392 such that adjustable stem 392 can be adjusted to a preset distance relative to a lower flange 374. This allows an operator to rotate handle 390 downwardly such that adjustable stem 392 operably clamps screen 38 against lower flange 374 thus securely holding screen 38 therein. With screen 38 in place, an operator can reach with his hand or with an elongated tool (not shown) to flip handle 390 up or down. Toggle clamps 388 also can be vertically adjusted by loosening anchor bolts (not shown) on slideable plate 395. Plate 395 attaches to a vertical adjuster 396 and includes a threaded shaft 397 extending through bracketry 389 and operably connected to slideable plate 395. Rotation of hand grip 398 and shaft 397 raises and lowers plate 395. Since clamps 388 are mounted on plate 395, clamp 388 are thereby vertically adjustable by use of vertical adjuster 396. An adjustable stop 399 prevents over-rotation of bracket 376 on pivot pin 380.

Outside screen holding device 36 (FIGS. 15, 15A, 16, and 16A) includes a clamping member 400 and a screen locating frame member 402. Clamping member 400 includes a C-shaped structural member 404 that receives the outside end of screen 38. C-shaped structural member 404 includes a lower flange 406 that supports screen 38, and further includes an outer web 407 and upper flange 408. Two outer clamps 410 each include a hand grip 412 and a downwardly extending shaft 414 that extends threadably through upper flange 408 with clamping foot (not shown). Outer clamps 410 can be twistingly tightened to securely clamp the outer end of screen 38 in place on lower flange 406. An inverted L-shaped bracket 418 is attached to the outer web 407 of C-shaped structural member 404 by fasteners 462. Fasteners 462 each include a bolt that protrudes through outer web 407, through a slot 464 in bracket 418, and threadable into a nut 466. Optimally, one or more vertical adjustment mechanisms 446, 448 extend downwardly threadable through bracket 418 and abut a stop (not shown) attached to outer web 407. By twistingly rotating mechanism 446, 448 when nuts 466 are loosened, the vertical height of L-shaped bracket 418 can be adjusted on C-shaped structural member 404. L-shaped bracket 418 includes a horizontal flange member 420 with locating slot 422 and hole 424 and slots 426 and 428. Locating holes 422 and 424 are adapted to accurately locate on locating pins 454 and 456. Slots 426 and 428 are positioned so that tie-down members 458 and 460 can slide forward onto flange 420 to releasably secure horizontal flange 420 (and clamping member 400) to locating frame member 402.

Locating frame member 402 (FIGS. 16 and 16A) is securely fixedly mounted to the top of horizontal railing 354 at each printing station 32, and includes multiple components for fine adjustment of the spatial location and orientation of screen 38 with respect to printing station 32. Locating frame member 402 includes a downwardly facing C-shaped base member 355. Upper horizontally adjustable member 432 is mounted to the top 430 of base member 355 by multiple horizontal adjustment mechanisms 434, 435, and 436. Twisting of the hand grips 438, 439, and 440 of the respective adjustment mechanisms 434, 435, and 436 horizontally adjusts horizontal adjustment member 432 to an infinite variety of positions and orientations with respect to base member 430. It is contemplated that adjustment mechanisms 434, 435, and 436 could be any of a number of different constructions. The construction shown includes a series of stand-off blocks (only some of which are shown, those being blocks 470, 472, and 474). The stand-off blocks space adjustable member 432 above top 430 of base member 355, and are attached to one of top 430 or adjustable member 432 and slideably mounted to the other of top 430 or member 432. Each adjustment mechanism 434, 435, and 436 includes a threaded shaft that engages one or more of the stand-off blocks so that as the threaded shafts are rotated, the stand-off blocks drag adjustable member 432 therealong. Adjustment mechanisms 434, 435, and 436 allow fine adjustment of screen 38 when outside screen holding device 36 is engaged and clamps 388 of inner screen holding device 37 are disengaged.

Figure 15:
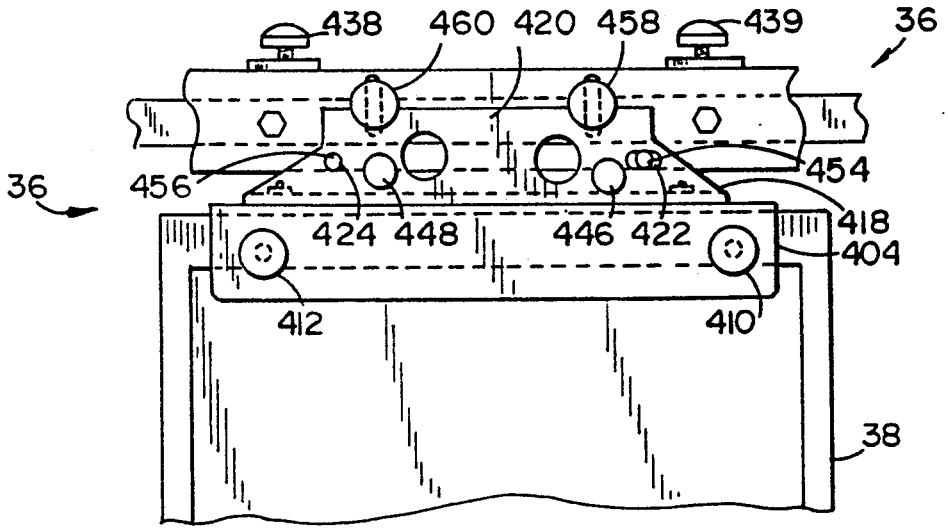
FIG. 15 is a plan view of a portion of the screen holding device with the screen in a downward, print-ready position.
Figure 16:
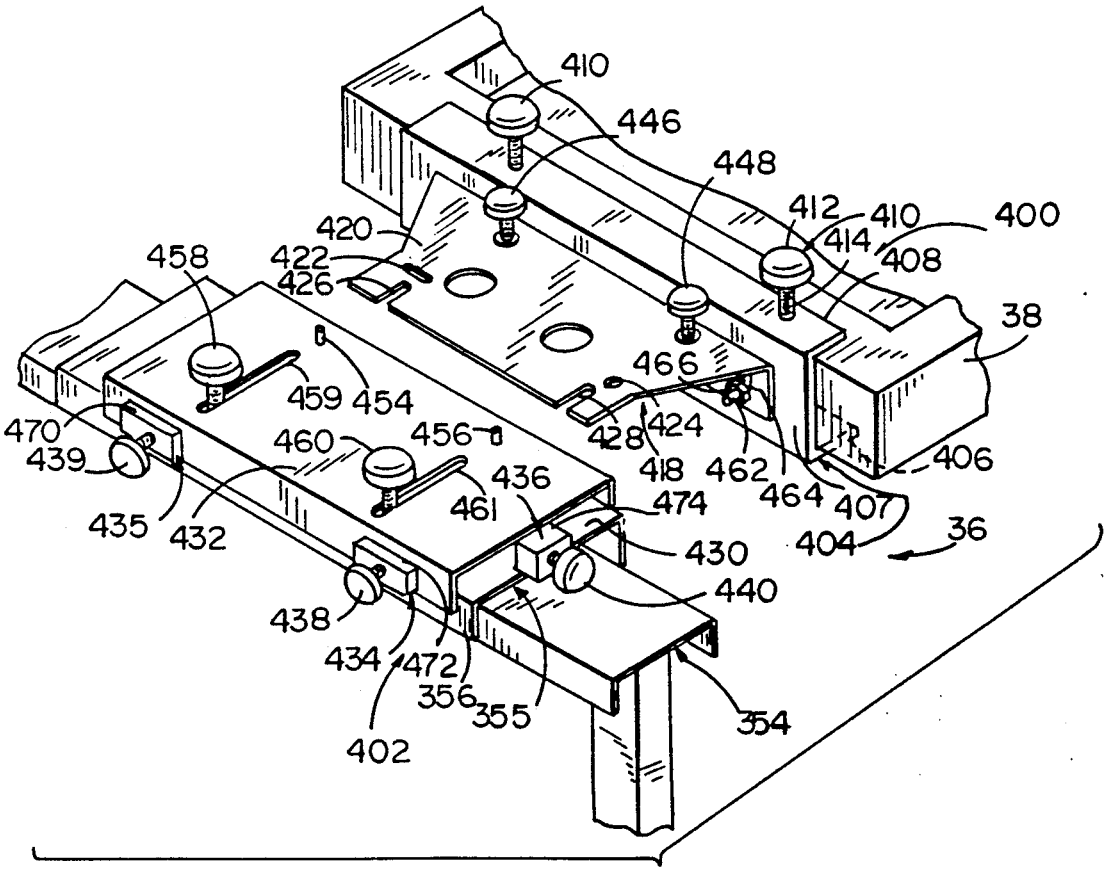
FIG. 16 is a perspective view of the device in FIG. 15, but with the screen partially raised.
Figure 15A:
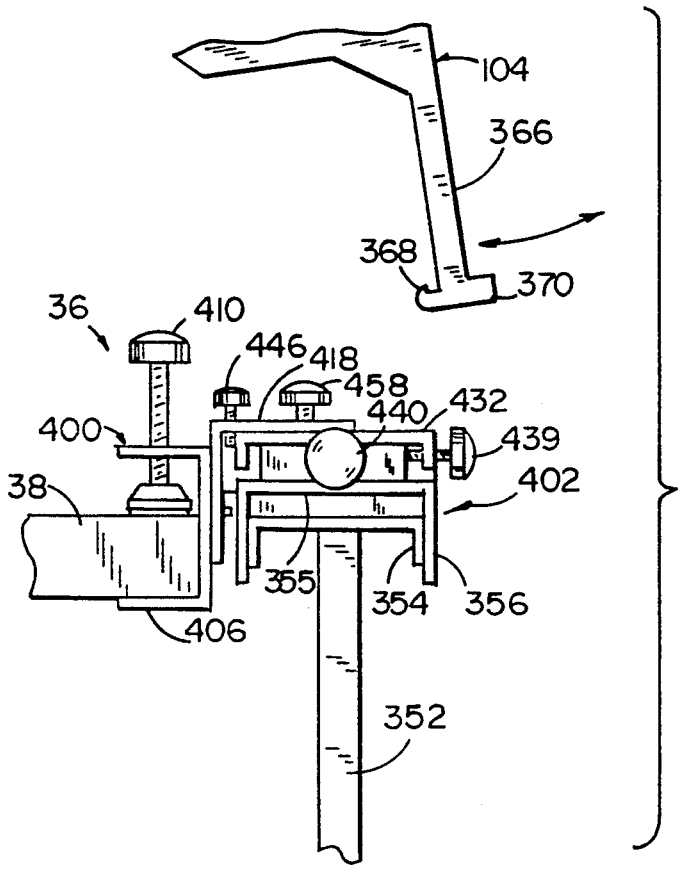
FIG. 15A is a side view of the apparatus in FIG. 15.
Figure 16A:
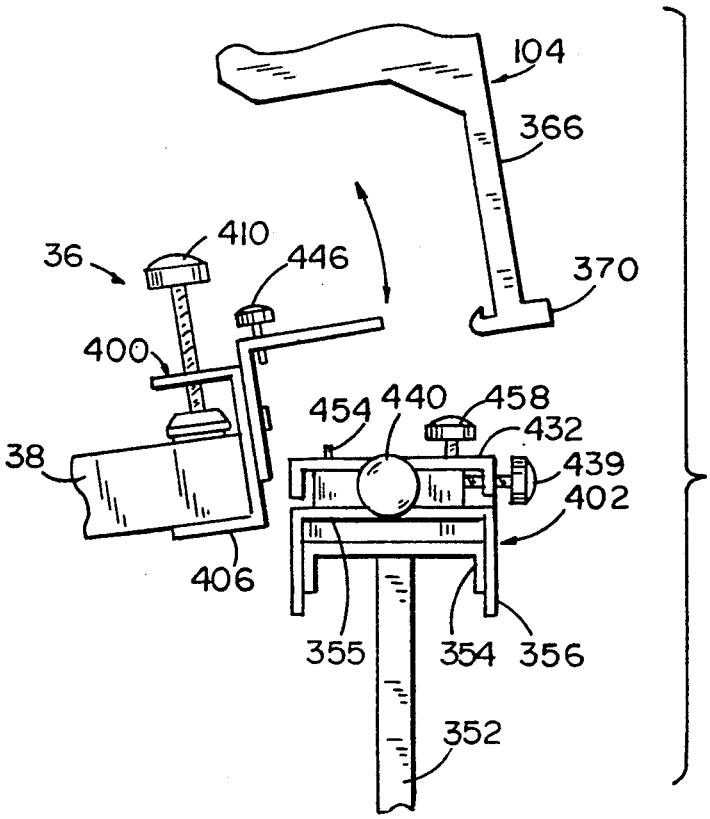
FIG. 16A is a side view of the apparatus in FIG. 16.
Figure 19:
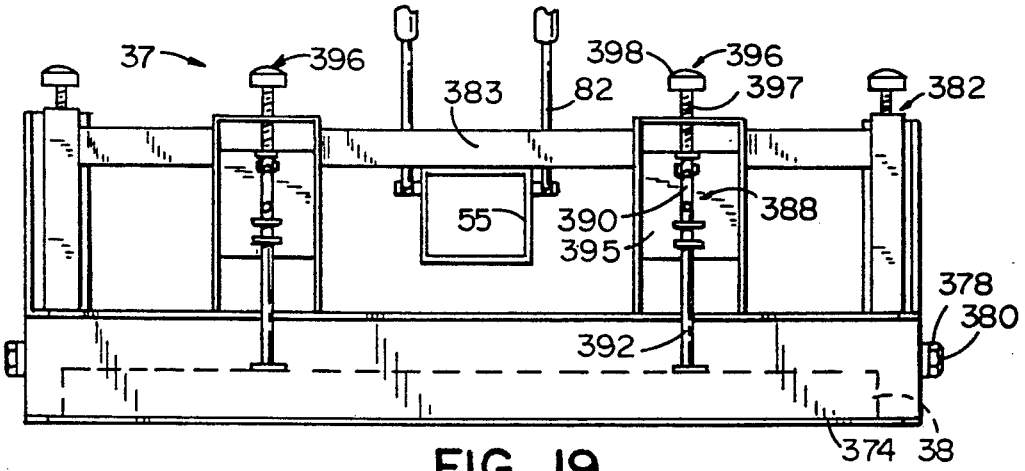
FIG. 19 is an elevational view of a portion of the device in FIG. 18.
Figure 18:
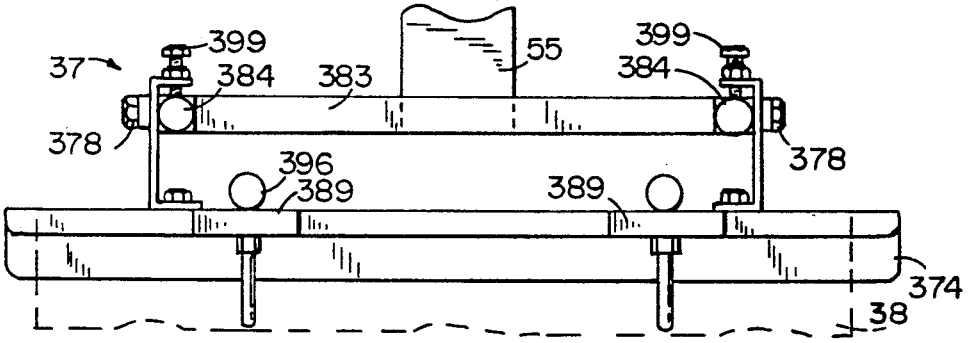
FIG. 18 is a plan view of the device in FIG. 17.
Figure 17:
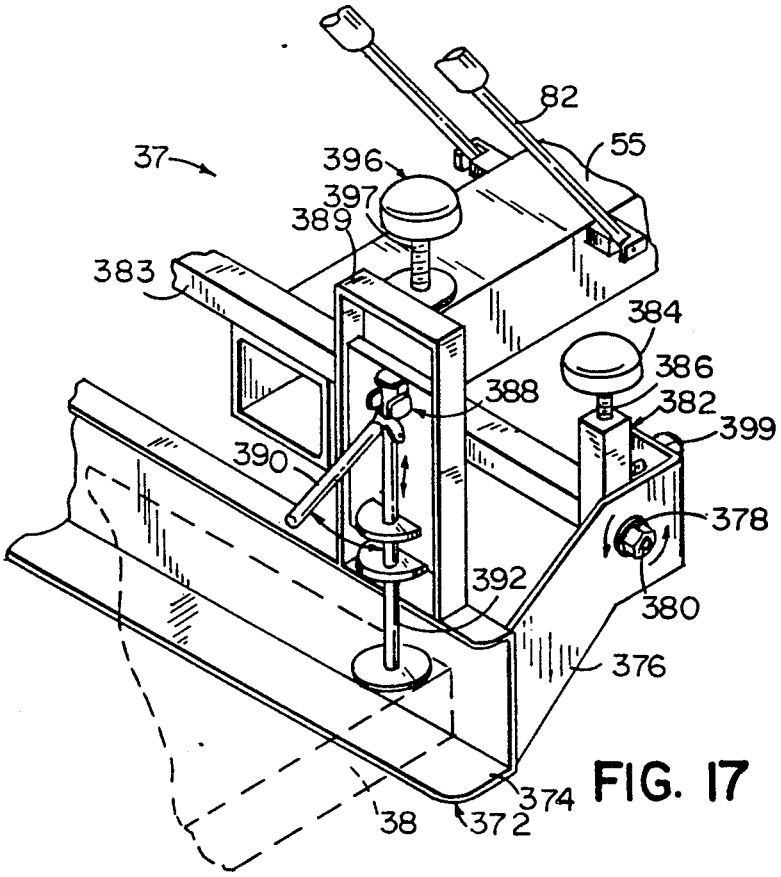
FIG. 17 is a perspective view of another portion of the screen holding device.

Adjustment member 432 further includes tie-down members 458 and 460 that slide within slots 459 and 461. Tie-down members 458 and 460 can be loosened and slid off of horizontal flange 420 of clamping member 400 to release clamping member 400 (FIGS. 16 and 16A), or can be slit into slots 426 and 428 on flange 420 and tightened to secure clamping member 400 to locating frame member 402 (FIGS. 15 and 15A).

Thus, if an operator desires to inspect a printed substrate 28 before it is removed from printing station 32, or if the operator desires to perform maintenance on screen 38 or clean screen 38, the operator releases printing head 30 as described previously, and then releases tie down members 458, 460 from clamping member 400. Screen 38 is then pivoted upwardly with clamping member 400 securely attached thereto and separating from screen locating frame member 402. With toggle clamps 388 engaged, screen 38 pivots upwardly about pivot pin 380 on the inner end about the end of beam 55. When the operator is done, the operator lowers screen 38 downwardly such that clamping member 400 engages locating frame member 402 with locating pins 454, 456 engaging locating slot 422 and hole 424. Tie down members 458, 460 are then slid forward and twistingly tightened to engage and secure the assembly in place.

A carriage track 120 (FIG. 2) is fastened to the underside and extends along the length of elongated central portion 102 of printing head 30, carriage track 120 being horizontally parallel to screen 38 when printing head 30 is in the lowered and locked print position. This allows carriage 40, which is slideably mounted to track 120, to translate horizontally on carriage track 120 a constant distance above screen 38.

A shifter tube 122 extends parallel to and below carriage track 120 between inner end 100 and outer end 104 of printing head 30. Shifter tube 122 includes laterally extending flanges 124 (FIG. 9) and 126 (FIG. 2) on either end which include offset holes 128 (FIG. 9) and 130 (FIG. 2) for pivotal attachment by pins 129 to inner end 100 and outer end 104 of printing head 30, respectively. Flange 124 (FIG. 9) further includes an elongated cable attachment member 132 for attachment of cable 42.

Figure 8:
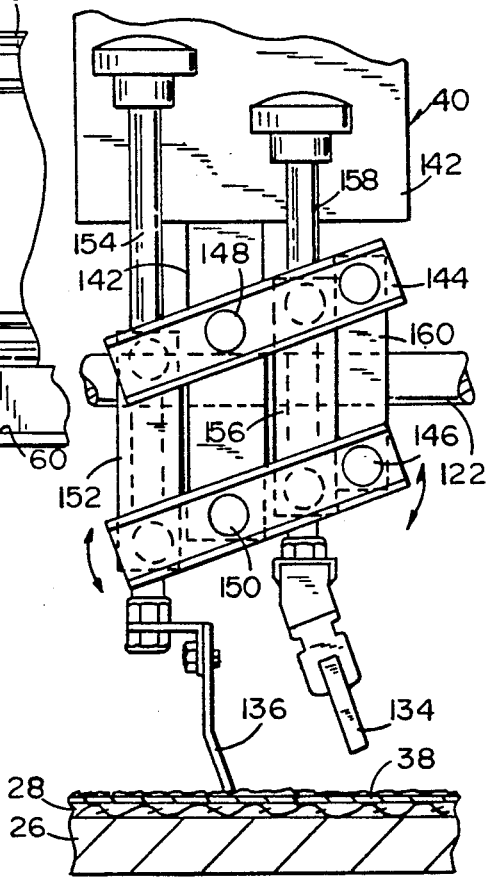
FIG. 8 is an enlarged side view of a portion of the squeegee and flood bar carriage shown in FIG. 2.

Carriage 40 (FIGS. 2 and 8) horizontally translates on carriage track 120 and carries a print squeegee 134 and flood bar 136. Carriage 40 includes a frame member 142 (FIG. 8) which has bearing means (not shown) to ride within carriage track 120 (FIG. 9) and provide a linear translating motion along the underside of printing head 30. Two pairs of spaced shift members 144 and 146 (FIG. 8) are pivotally mounted on vertical frame member 142 through centrally located holes 148 and 150 on members 144 and 146. Flood bar adjustment mechanism 152 is pivotally attached to the outer ends of spaced shift members 144 and 146. Flood bar 136 attaches to the lower end of adjustment mechanism 152 and is vertically adjustable through adjustment screw 154. Similarly, a squeegee adjustment mechanism 156 attaches to the inner end of spaced shift members 144 and 146. Squeegee 134 attaches to the lower end of mechanism 156 and is adjustable through adjustment screw 158. Shift members 144 and 146 and mechanisms 152 and 156 form a parallelogram type linkage arrangement which pivotally moves up and down on carriage frame member 142 in teeter-totter like fashion. Also mounted to spaced shift members 144 and 146 is a shifter tube bearing 160 which is pivotally attached to the inner end of spaced shift members 144 and 146. Shifter tube bearing 160 mateably engages shifter tube 122 and is directed up and down as shifter tube 122 moves up and down, thereby causing shift members 144 and 146 and mechanisms 152 and 156 to shift vertically.

A telescoping cable 42' (FIG. 2) is utilized to shift squeegee 134 and flood bar 136 on carriage 40 between print and flood positions. Motor 90 (FIGS. 6 and 7) couples to a horizontally extending shaft 180 supported by bearing stands 182 and 184 as noted previously. Circular plate or cam 186 is attached to an end 188 of shaft 180 and includes an eccentrically mounted offset ball joint 190. Adjacent end 188 is an upstanding bracket 192 with slot 194 to facilitate mounting of cable 42.

Figure 9:
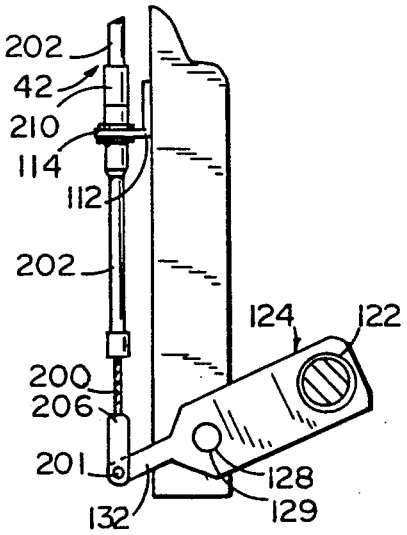
FIG. 9 is a cross-sectional view taken along the plane IX—IX in FIG. 3.

Telescoping cable 42 (FIGS. 7 and 9) includes an inner flexible cable 200 slideably housed within sleeve 202. Inner cable 200 includes lower attachment end 204 and sleeve 202 correspondingly includes lower attachment end 208 (FIG. 7) while inner cable 200 further includes an upper attachment end 206 and sleeve 202 an upper attachment end 210 (FIG. 9). Cable end 208 (FIG. 7) attaches to slot 194 (FIG. 6) within bracket 192 on shelf 54 of main frame 22, and cable end 204 (FIG. 7) attaches to offset ball joint 190 on cam 186. Sleeve 210 (FIG. 9) attaches to slot 114 of upper bracket 112 on side 108 of inner end 100 of printing head 30, and end 206 of cable 200 pivotally attaches at pin 201 to elongated attachment member 132 of flange 124 of shifter tube 122. As motor 90 rotates cam 186 (FIG. 7), ball joint 190 telescopingly slides inner cable 200 thru sleeve 202. Cable 200 (FIG. 9) thereby causes flange 124 of shifter tube 122 to pivot about pins 129 thus shifting tube 122 upwardly (or downwardly). Tube 122, in turn, carries bearing 160 (FIG. 8) with it, thus shifting squeegee 134 and flood bar 136 between print and flood position.

The same switches 228 and 230 (FIG. 7) used for registration system 50 also control the 180° rotation of motor means 90 for the shift cable system. Switch 228 is tripped by trip cam 232 when cable 42 is fully extended and switch 230 is tripped by trip cam 232 when cable 42 is fully retracted.

Mounted to inner end 100 of printing head 30 (FIG. 2) is a carriage drive motor 162 which turns sprocket 163 and endless chain 166, thus actuating sprocket 164. Sprocket 164 rides on and actuates primary axle 168 which is rotatably mounted and in turn actuates sprocket 170. Secondary drive chain 172 wraps around sprocket 170 and extends the length of elongated central portion 102 and wraps around idler sprocket 174 mounted in central portion 102 near outer end 104. Secondary drive chain 172 attaches to carriage 40 via carriage frame member 142 and cooperates with bearing means thereon to drive carriage 40 fore and aft along track 120.

Figure 12:
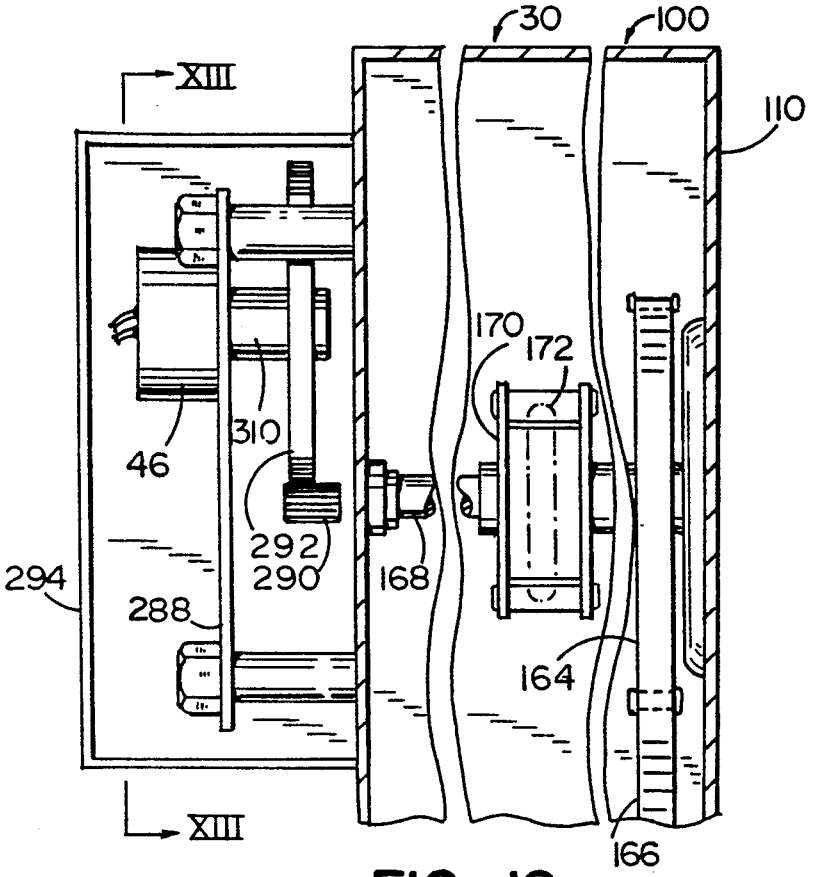
FIG. 12 is an enlarged partially broken-away cross-sectional view taken along the plane XII—XII in FIG. 3.
Figure 13:
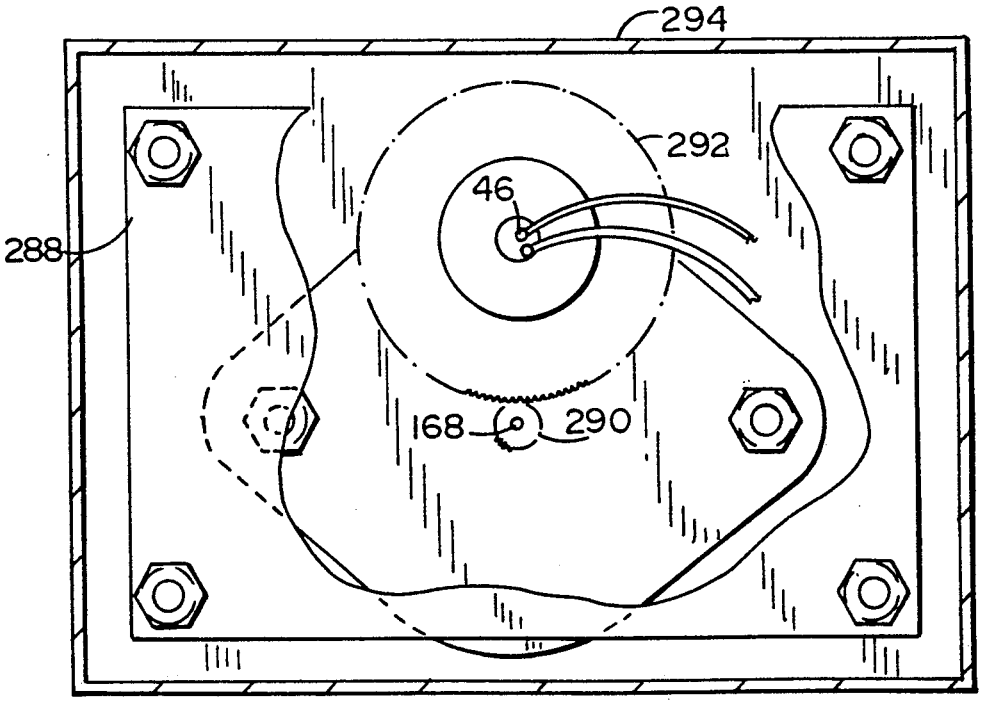
FIG. 13 is a side cross-sectional view taken along the plane XIII—XIII in FIG. 12.

A potentiometer 46 (FIGS. 12 and 13) is mounted to side 108 of each printing head 30 on bracketry 288 adjacent carriage drive axle 168. A reduction gear 290 mounted on axle 168 rotationally engages a gear 292 which is axially mounted on a wiper actuator 310 of potentiometer 46. In the preferred embodiment, gears 290 and 292 achieve a seven to one reduction of the rotation of drive axle 168, though any ratio desired can be used. The rotation transmitted to potentiometer 46 by gears 290, 292 is proportional to the linear displacement of carriage 40. Gears 290, 292 and potentiometer 46 are housed within housing 294 for protection and ease of access.

Figure 14:
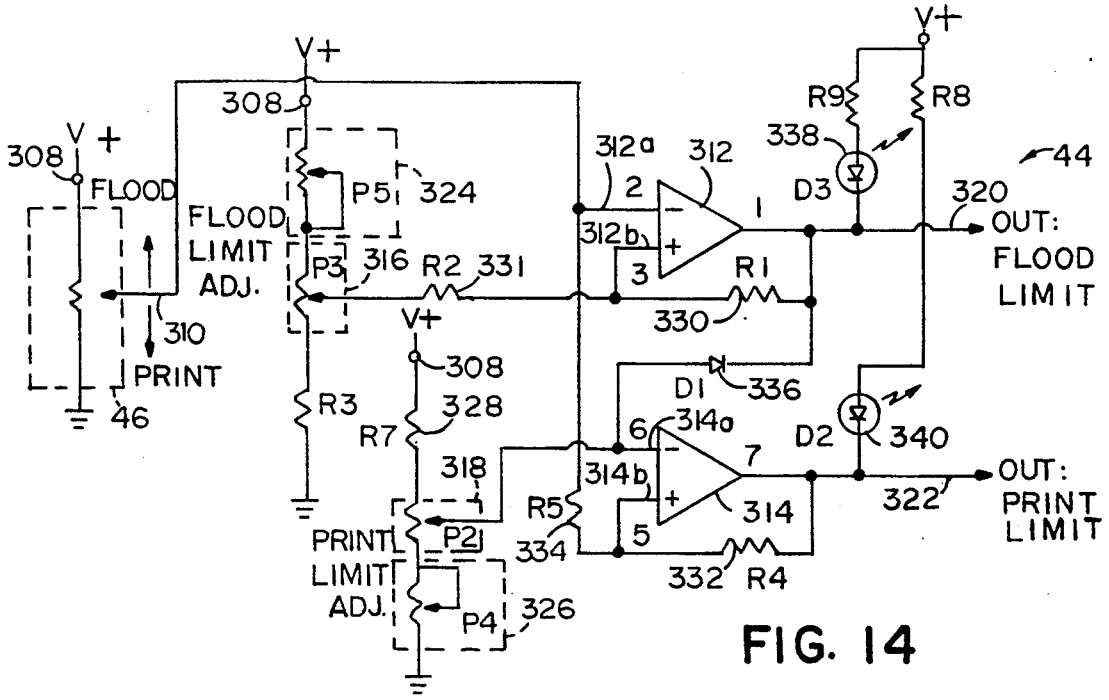
FIG. 14 is an electrical schematic of the carriage position sensing circuit incorporating the potentiometer.
Figure 4:
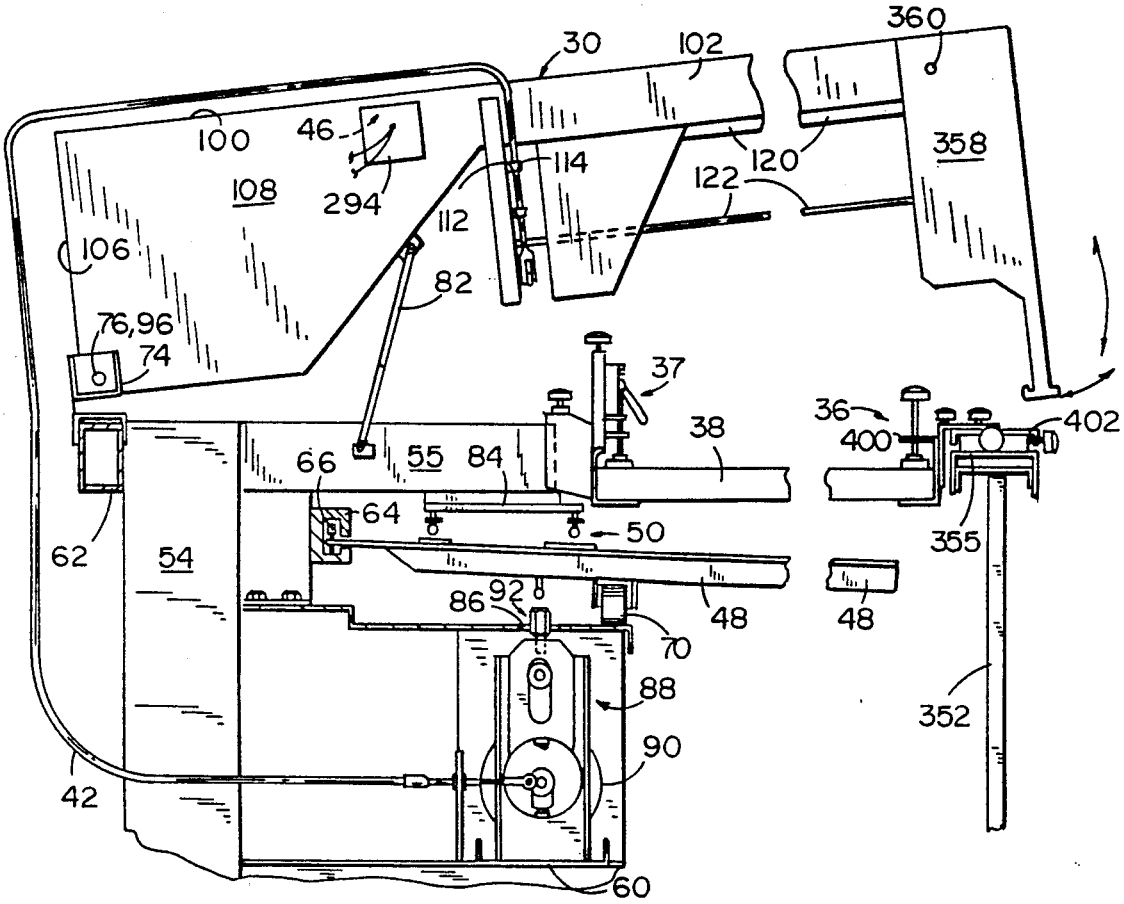
FIG. 4 is an elevational view of a printing press similar to FIG. 3 but with the printing head raised to a non-printing position.
Figure 5:
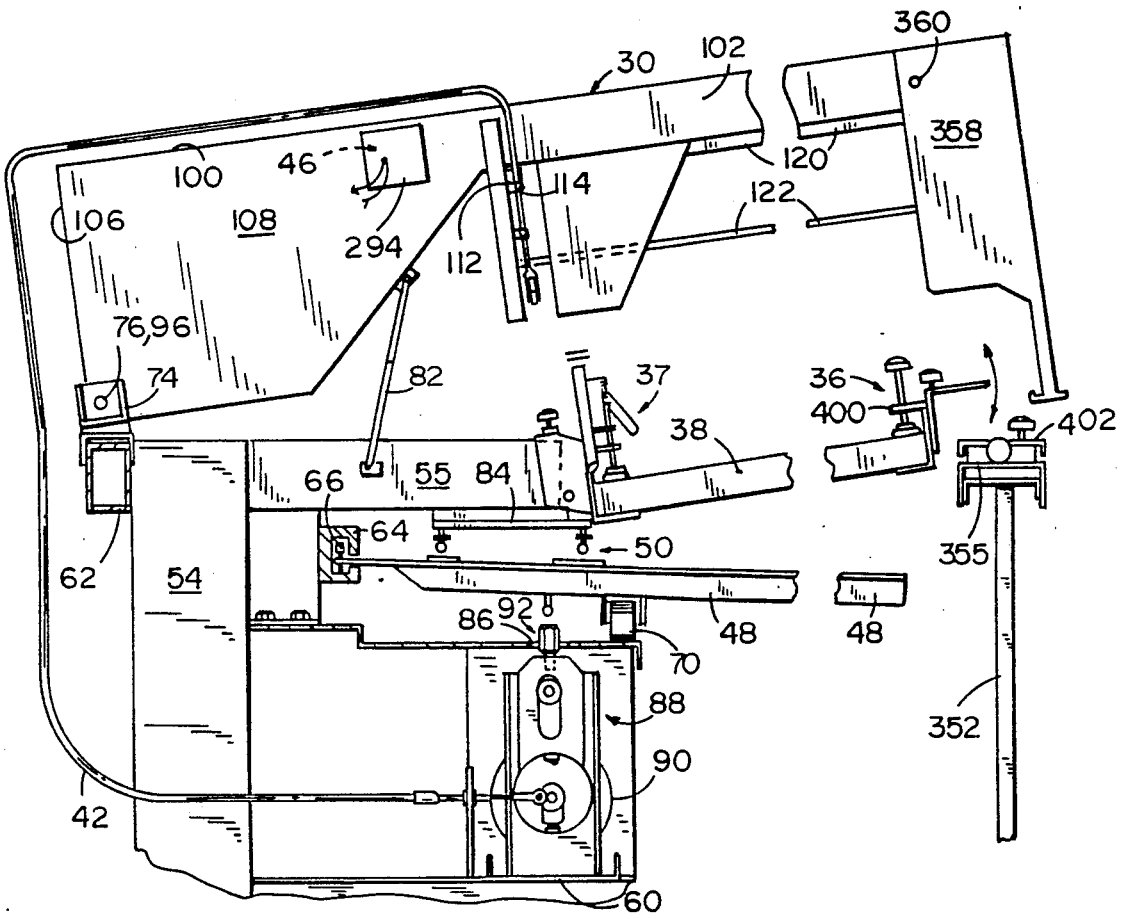
FIG. 5 is an elevational view of a printing press similar to FIG. 4 but with the screen raised to a non-printing position.

Potentiometer 46 is electrically connected to a carriage position control circuit 44 (FIG. 14) which is used for monitoring the position of carriage 40 and for communicating with the printing press control circuitry to stop carriage 40 when a given limit stop position is reached. Both the extension and retraction limit stop positions are made easily adjustable by the carriage position control circuit 44 (FIG. 14). The potentiometer 46 is preferably of the continuous type thus allowing continuous sensing of the carriage 40 position. Additionally, potentiometer 46 is preferably a high revolution life potentiometer. An example of a position potentiometer which can be used is a bushing mounted potentiometer with a no load rotational life of about ten million shaft revolutions.

As illustrated in FIG. 14, with a DC voltage from source 308 applied to potentiometer 46, wiper 310 detects a voltage representative of the location of carriage 40. This information is input to two differential operational amplifiers (DOA) 312 and 314. Specifically, the carriage location reference voltage is input to the negative input 312*a* of a first amplifier 312, and to the positive input 314*b* on the second amplifier 314. Control limit potentiometers 316 and 318 are also operably connected to source voltage 308. Potentiometers 316 and 318 are useful for setting reference voltage inputs into DOA 312 and 314. Wipers of potentiometers 316, 318 are connected to the opposing inputs of amplifiers 312 and 31 (positive input 312*b* and negative input 314*a*, respectively) to provide an adjustable reference voltage input.

By the above noted arrangement, DOA 312 determines the flood limit stop position for carriage 40 by comparing the output from wiper 310 of potentiometer 46 (referencing the carriage position) with the output from the wiper of potentiometer 316 (referencing the desired flood limit stop position). When the two signals reverse polarity, a flood limit stop position signal is output from DOA 312 at output connection 320. Similarly, DOA 314 compares the output from wiper 310 of potentiometer 46 (referencing the carriage position) with the output from the wiper of potentiometer 318 (referencing the desired squeegee limit stop position). When the two signals reverse polarity, a print limit stop position signal is output from DOA 314 at connection 322.

To prevent dead head at the end of the carriage stroke length, trim potentiometer 324 is connected in series with source 308 and potentiometer 316, and trim potentiometer 326 and resister 328 are connected in series with potentiometer 318. Potentiometers 324 and 326 adjustably vary the voltage supplied to potentiometers 316 and 318, thus allowing the full voltage range of potentiometers 316 and 318 to be used. This also allows an operator to eliminate dead space on the track at the end of the stroke defined by the carriage movement.

To prevent chatter and promote positive control by carriage position control circuit 44, resisters 330, 331, 332 and 334 can be added. Resister 332 is connected between output 322 and input 314*b* of DOA 314. Resister 334 is connected between the location reference voltage and input 314*b* of DOA 314. Resister 334 acts as a voltage divider in conjunction with resister 332 to control the amount of positive feedback associated with DOA 314. This creates a hysteresis effect on DOA 314 which reduces the tendency of DOA 314 to cycle repeatedly on and off as carriage 40 approaches an end of its stroke. The above describes the way in which 332, 334 and DOA 314 work. The same discussion would apply to the way 330, 331 and DOA 312 work.

One or more diodes can also be added. Diode 336 is connected between DOA output connections 320 and DOA input 314*a* to prevent both limit stops from being activated simultaneously. Also indicator lights 338 and 340 indicate when DOA's 312 and 314 are generating output signals to connections 320 and 322, respectively.

The operation of printing press 20 is generally described as follows. Substrates 28 are placed upon platens 26 on elongated arms 48 at load/unload stations 34. As printer 20 cycles, platens 26 and arms 48 move around oval track 24 sequentially to each printing station 32. During this entire sequence, screen holding device 36 and 37 holds screen 38 downwardly in print-ready position (FIG. 3), and printing head 30 holds carriage 40 downwardly over screen 38 in a print-ready position. Drive means 72 moves platens 26 sequentially laterally to each printing station 32, stopping platens 26 at each printing station 32. Motor 90 is then activated causing lift mechanism 88 to thrust upwardly through opening 86 in track 24 and against elongated arm 48, thus causing arm 48 to register against register plate 84 of registration system 50 (FIG. 2). Simultaneously as arm 48 and platen 26 move toward a fully registered position, carriage 40 lowers print squeegee 134 to a print position (and raises flood bar 136) by action of cable 42. Specifically, motor 90 causes inner cable 200 to telescopingly slide through sleeve 202, thus shifting shifter tube 122. Shifter tube 122 in turn causes squeegee 134 and flood bar 136 on carriage 40 to shift. Switch 228 signals that motor 90 has fully registered arm 48 and shifted carriage 40, and that the print cycle is ready to begin.

Once arm 48 is fully in position and registered, carriage 40 then translates across screen 38 and squeegee 134 causing ink to print thru screen 38 onto substrate 28. After printing, carriage 40 sequentially lowers flood bar 136 to a flood position (and raises print squeegee 134), and then translates across screen 38 in a reverse direction causing ink to spread or flood across screen 36 in preparation of the next print cycle. As carriage 40 lowers flood bar 136 by cable 42, lift mechanism 88 simultaneously lowers and releases arm 48. Switch 230 signals that motor 90 has fully released arm 48 and shifted carriage 40, and that arm 48 is ready to be laterally moved to the next station 32 (or 34). Printer 20 then moves platens 26 laterally to the next station 32 for printing or station 34 for unloading. Printer 20 continues this cycling from station to station until substrate 28 is properly printed upon and has cycled back to load/unload stations 34. Substrate 28 is then removed and a new substrate 28 is placed on platen 26. The cycle is then repeated.

As described previously, screen printer 20 is optimally designed to increase access for maintenance and also setup by providing a pivotable printing head 30 and pivotable screen holding devices 36, 37. Printer 20 is particularly adapted to allow increased physical and visual access to partially printed or fully printed substrates 28 before the substrates leave the printing station 32. Also, an operator can release the toggle clamps 388 on inner screen holding device 37 and adjust the location and orientation of screen 38 by use of the fine adjustment mechanisms 434, 435, 436, 446, and 448 on locating frame member 402. When screen 38 is properly located, toggle clamps 388 on inner screen holding device 37 can be re-engaged to securely locate screen 38 at printing station 32.

If an operator desires to inspect a printed substrate 28, the operator releases clamping member 400 from locating frame member 402 by releasing tie down members 458 and 460. With clamping member 400 loosened and slid away, clamping member 400 and screen 38 can be pivoted upwardly about pivot pins 380 on inner screen holding device 37. Thus, substrate 28 can be clearly viewed and also the underside of screen 38 can be cleaned. When done, the operator can place screen 38 downwardly such that clamping member 400 is located on locating member 402 with locating pins 454 and 456 accurately engaging locating holes 422, 424.

In view of the foregoing description, those of ordinary skill in the art will undoubtedly envision various modifications to the present invention which will not depart from the inventive concepts disclosed herein. Therefore, it is expressly intended that the above description should be considered as only that of the preferred embodiment. The true spirit and scope of the present invention may be determined by reference to the appended claims.

The embodiments of the invention in which an exclusive property or privilege is claimed are defined as follows.

1. A screen printer for printing ink through a screen comprising:

at least one printing head defining a printing station;

a translatable carriage operably attached to said printing head;

printing means for printing through the screen, said printing means being located on said translatable carriage;

flooding means for flooding ink across the screen, said flooding means also being located on said translatable carriage;

shifting means for shifting said printing means and said flooding means between a print position and a flood position, said shifting means being operably connected to said translatable carriage;

a motor located remote from said carriage for actuating said shifting means, said motor including a shaft and a joint operably connected to said shaft but axially offset from said shaft; and cable means for transmitting motion from said remote motor to said shifting means, said cable means including a cable having a pair of ends, one of said ends being operably connected to said joint for reciprocal movement and extending from said motor, and the other of said ends being operably connected to said shifting means;

whereby said motor means actuates said shifting means through said cable means.

2. The device defined in claim 1 wherein said cable includes a sleeve and an internal cable, said internal cable being designed to telescopingly slide within said sleeve.

3. A screen printer for printing ink through a screen comprising:

at least one printing head defining a printing station;

a translatable carriage operably attached to said printing head;

printing means for printing through the screen, said printing means being located on said translatable carriage;

flooding means for flooding ink across the screen, said flooding means also being located on said translatable carriage;

shifting means for shifting said printing means and said flooding means between a print position and a flood position, said shifting means being operably connected to said translatable carriage;

a motor located remote from said carriage for actuating said shifting means;

cable means for transmitting motion from said remote motor to said shifting means, said cable means including a cable operably connected to and extending from said motor to said shifting means;

said cable including a sleeve and an internal cable, said internal cable being designed to telescopingly slide within said sleeve;

said motor including a rotatable shaft; and said means for shifting including means for attaching said internal cable to said shaft such that actuating said motor turns said shaft causing said internal cable to telescopingly slide within said sleeve, whereby said motor means actuates said shifting means through said cable means.

4. The device defined in claim 3 wherein said means for attaching is a ball joint mounted axially offset on said motor shaft.

5. A screen printer for printing ink through a screen comprising:

at least one printing head defining a printing station;

a translatable carriage operably attached to said printing head;

printing means for printing through the screen, said printing means being located on said translatable carriage;

flooding means for flooding ink across the screen, said flooding means also being located on said translatable carriage;

shifting means for shifting said printing means and said flooding means between a print position and a flood position, said shifting means being operably connected to said translatable carriage;

a motor located remote from said carriage for actuating said shifting means;

cable means for transmitting motion from said remote motor to said shifting means, said cable means including a cable operably connected to and extending from said motor to said shifting means;

said cable including a sleeve and an internal cable, said internal cable being designed to telescopingly slide within said sleeve;

said means for shifting including shift members located on said carriage operably connected to said printing means and said flooding means, and further including a shift bushing attached to said shift members for cooperating therewith, said means for shifting still further including an elongated shift tube extending parallel to and substantially the length of said printing head, said shift tube being pivotally mounted at each end to said printing head and further slidingly passing through said shift bushing for cooperating therewith, said shift tube including a flange for mounting said internal cable thereto; and said internal cable being operably attached to said flange to cooperatingly simultaneously shift said shift tube, shift bushing, and shift members between said print position and said flood position, whereby said motor means actuates said shifting means through said cable means.

6. The device as defined in claim 5 wherein said shift tube includes offset brackets at both ends which are pivotally mounted to said printing head such that said shift tube vertically translates during shifting.

7. A screen printer for printing ink through a screen comprising:

at least one printing head defining a printing station;

a translatable carriage operably attached to said printing head;

printing means for printing through the screen, said printing means being located on said translatable carriage;

flooding means for flooding ink across the screen, said flooding means also being located on said translatable carriage;

shifting means for shifting said printing means and said flooding means between a print position and a flood position, said shifting means being operably connected to said translatable carriage;

a motor located remote from said carriage for actuating said shifting means;

cable means for transmitting motion from said remote motor to said shifting means, said cable means including a cable operably connected to and extending from said motor to said shifting means;

said cable including a sleeve and an internal cable, said internal cable being designed to telescopingly slide within said sleeve; and said motor including a shaft including a first translatable mounting bracket, said means for shifting including a second translatable mounting bracket, and the ends of said internal cable being operably connected to said first and second translatable mounting brackets, thus providing an arrangement wherein said motor communicates with said means for shifting, whereby said motor means actuates said shifting means through said cable means.

8. The device defined in claim 7 wherein said first translatable mounting bracket is a ball joint mounted offset on said motor shaft.

9. The device defined in claim 8 wherein said means for shifting includes a shift bushing attached to said shift members on said carriage and further includes an elongated shift tube that extends parallel to and substantially the length of said printing head, said shift tube being pivotally mounted at each end to said printing head and further slidingly passed through said shift bushing, said shift tube including a flange which incorporates said second translatable mounting bracket for mounting said cable thereto;

whereby said cable operably connects said motor to said shift tube and shift members to thereby shift said squeegee and flood bar.

10. A screen printer for printing ink through a screen comprising:

at least one printing head defining a printing station;

a translatable carriage operably attached to said printing head;

printing means for printing through the screen, said printing means being located on said translatable carriage;

flooding means for flooding ink across the screen, said flooding means also being located on said translatable carriage;

shifting means for shifting said printing means and said flooding means between a print position and a flood position, said shifting means being operably connected to said translatable carriage;

a motor located remote from said carriage for actuating said shifting means;

cable means for transmitting motion from said remote motor to said shifting means, said cable means including a cable operably connected to and extending from said motor to said shifting means;

whereby said motor means actuates said shifting means through said cable means;

a first locating member associated with said printing station;

a movable arm adapted to carry a substrate to be printed on, said movable arm being locatable at said printing station and being movable between a preprint and print position, said movable arm including a second locating member;

said first and second locating members defining a registration system that registers said movable arm as said movable arm is moved to said print position; and lifting means for moving said movable arm between said preprint position and said print position; said lifting means being actuated by said motor that actuates said shifting means.

11. The device defined in claim 10 wherein said first and second locating members form a ball and seat arrangement for locating said arm in said print position.

12. The device defined in claim 10 wherein said registration system includes a three-point system of registration.

13. The device defined in claim 12 wherein said lifting means includes a cam mounted on said motor, and an uplifting member including a follower that engages said cam, said uplifting member adapted to move said movable arm between said preprint and print positions as said cam is rotated by said motor.

14. The device defined in claim 10 wherein said printing head includes an elongated track, and wherein said carriage engages said elongated track and is movable along said elongated track between an extended stop position and a retracted stop position; and including actuator means for moving said carriage; a first potentiometer for sensing the position of said carriage, said first potentiometer operably connected to said actuator means to generate a first potentiometer output signal representing the location of said carriage along said elongated track means; and control means for interpreting said first potentiometer output signal, said control means operably connected to said actuating means to set at least one of said stop positions.

15. The device defined in claim 14 wherein said first potentiometer is a continuous output potentiometer.

16. The device defined in claim 15 wherein said first potentiometer is connected to an electrical supply and ground and includes a first wiper, said first wiper detecting and transmitting said first potentiometer output signal representing carriage location, and wherein said control means includes as least one differential operational amplifier (DOA) having an input terminal operably connected to said first wiper to receive said first potentiometer output signal, said DOA generating a DOA output signal which cooperates with said actuator means to set at least one of said stop positions for said carriage on said elongated track means.

17. The device defined in claim 16 including at least one control limit potentiometer having a wiper operably connected to a second input terminal on said DOA, said control limit potentiometer operably connected to an electrical supply and ground, said control limit potentiometer wiper detecting and transmitting a control limit potentiometer output signal representing an adjustable carriage stop position; and said DOA receiving said first potentiometer output signal and said control limit potentiometer output signal and generating said DOA output signal when the polarity between said output signals reverses, said DOA being operably connected to said actuating means to thereby stop the movement of said carriage.

18. The device defined in claim 17 including at least one trim potentiometer operably connected in series with said control limit potentiometer and the electrical supply connected thereto, said trim potentiometer being adapted to adjustably vary the voltage supplied to said trim potentiometer to thereby set the range of adjustability of said control limit potentiometer output signal to correspond to the range of motion by said carriage and to thereby permit adjustment so as to prevent dead space at the end of the stroke defined by carriage movement along said elongated track means.

19. The device defined in claim 14 wherein said screen printer includes a frame, and wherein said printing head is pivotally mounted to said frame and movable between a lowered print position which is consistently maintained during normal operation of said screen printer and a raised position which is useful for maintenance of said screen printer; and latch means for latching said printing head in said lowered print position.

20. The device defined in claim 19 including a screen holding means for holding said screen, said screen holding means pivotally mounted to said frame and permitting said screen to be moved between a lowered print position which is consistently maintained during normal operation of said screen printer, and a raised position which is useful for cleaning said screen and for maintenance of said screen printer; and release means for releasably but securely holding said screen holding means in said lowered print position.

21. A screen printer for printing ink through a screen onto a substrate comprising:

a frame including at least one printing head defining a printing station;

a first register plate mounted to said frame at said printing station, said register plate including at least one first locating member;

a movable arm for carrying the substrate locatable at said printing station and moveable between a preprint position and a print position;

a second register plate mounted to said moveable arm and located on said moveable arm so as to correspond to said first register plate, said second register plate including at least one second locating member shaped to operably engage said first locating member when said moveable arm is moved to said print position, said first and second locating members forming a ball and seat arrangement to repeatably locate said moveable arm at said printing station; and lifting means for lifting said moveable arm to said print position, said lifting means including a contacting member and said arm including a receiving member, said contacting member and said receiving member forming a second ball and seat arrangement.

22. A screen printer for printing ink through a screen onto a substrate comprising:

a frame including at least one printing head defining a printing station;

a first register plate mounted to said frame at said printing station, said register plate including at least one first locating member;

a movable arm for carrying the substrate locatable at said printing station and moveable between a preprint position and a print position;

a second register plate mounted to said moveable arm and located on said moveable arm so as to correspond to said first register plate, said second register plate including at least one second locating member shaped to operably engage said first locating member when said moveable arm is moved to said print position, said first and second located members forming a ball and seat arrangement to repeatably locate said moveable arm at printing station;

lifting means for lifting said moveable arm to said print position; and said first register plate and said second register plate including at least three of each of said first and second locating members to thereby form a three point registration system to repeatably locate said arm in said print position at said printing station.

23. The device defined in claim 22 wherein said seat of said ball and seat arrangement is cup-shaped with ramped sides and operably formed to receive and guide the ball of said ball and seat arrangement to a repeatable and aligned location and further to reliably release said ball as said arm is moved from said print position to said preprint position.

24. The device defined in claim 23 wherein said lifting means includes a third member, wherein said arm includes a fourth member, and said third and fourth members form a ball and seat arrangement located such that said lifting means creates a lifting force through said third and fourth members that extends upwardly through the triangle formed by said three point registration system thereby permitting some misalignment between said lifting means and said arm while still securely registering said arm at said printing station.

25. A screen printer for printing ink through a screen onto a substrate comprising:

a frame including at least one printing head defining a printing station;

a first register plate mounted to said frame at said printing station, said register plate including at least one first locating member;

a moveable arm for carrying the substrate locatable at said printing station and moveable between a preprint position and a print position;

a second register plate mounted to said movable arm and located on said movable arm so as to correspond to said first register plate, said second register plate including at least one second locating member shaped to operably engage said first locating member when said moveable arm is moved to said print position, said first and second locating members forming a ball and seat arrangement to repeatably locate said moveable arm at said printing station;

lifting means for lifting said moveable arm to said print position;

a squeegee and flood bar carriage located on said printing head, said carriage being shiftable between a print position and a flood position; and shifting means for shifting said carriage, said shifting means including a motor; said lifting means being operably connected to and powered by said motor.

26. The device defined in claim 25 wherein said lifting means includes a cam mounted on said motor and a follower which cooperates with said cam to lift said arm.

27. The device defined in claim 26 wherein said lifting means includes a vertically movable uplifting member, said uplifting member including said third member; and wherein said follower includes guide means for directing said uplifting member vertically and also for positioning said follower on said cam.

28. A screen printer for printing ink through a plurality of screens, comprising:

a main frame;

a plurality of printing heads located around said main frame, each printing head defining a printing station on said main frame and including means for retaining one of the screens and means for printing ink through the one screen, each of said printing heads being pivotally mounted to said main frame and movable between a lowered print position which is consistently maintained during normal operation of said screen printer and a raised maintenance position which is useful for maintenance of said screen printer;

a plurality of substrate carrying arms operably connected to said frame;

means for moving each of said arms laterally sequentially to individual of said printing heads;

means for vertical lifting said arms to a print position at each of said printing stations; and latch means for latching each of said printing heads in said lowered print position.

29. The device defined in claim 28 wherein said latch means includes a releasable hook and catch arrangement for securely holding said printing head in said lowered position and for releasing said printing head to said raised position.

30. The device defined in claim 29 including lift assists mounted between said printing head and said main frame to assist in lifting said printing head.

31. The device defined in claim 30 wherein said lift assists are gas struts.

32. The device defined in claim 31 including a subframe extending partially around the perimeter of said main frame and spaced outwardly from said main frame, said subframe forming a part of said hook and catch arrangement of said latch means.

33. A screen printer for printing ink through a screen, comprising:

a main frame;

at least one printing head defining a printing station on said main frame and including means for printing ink through said screen, said printing head pivotally mounted to said main frame and movable between a lowered print position which is consistently maintained during normal operation of said screen printer and a raised position which is useful for maintenance of said screen printer;

latch means for latching said printing head in said lowered print position;

a screen holding means for holding said screen, said screen holding means being pivotally mounted to said main frame and permitting said screen to be moved between a lowered print position which is consistently maintained during normal operation of said screen printer, and a raised position which is useful for cleaning said screen and for maintenance of said screen printer; and release means for releasably but securely holding said screen holding means in said lowered print position.

34. The device defined in claim 33 wherein said screen holding means includes a screen locater means for accurately locating the screen when the screen is returned to said lowered print position.

35. The device defined in claim 34 wherein said screen holding means includes fine adjustment means for adjusting the position of the screen when in said lowered print position.

36. The device defined in claim 35 wherein said screen holding means has opposing ends, one of said opposing ends being pivotally mounted to said main frame, and the other of said opposing ends including said release means.

37. The device defined in claim 36 wherein said release means includes a first clamping member that clamps onto the screen and travels with the screen when the screen is pivoted to the raised position, and further includes a screen locating frame member that releasably mateably couples to and locates said clamping member when the screen is returned to said lowered print position, said first clamping member and said locating frame member forming said screen locator means.

38. The device defined in claim 37 wherein said locating frame member and said first clamping member include said fine adjustment means, said fine adjustment means including adjusting means for adjusting the spatial position of said screen relative to said printing head.

39. The device defined in claim 38 wherein said screen holding means includes at least one toggle adapted to clampingly hold the screen in place.

40. The device as defined in claim 33 including a subframe extending partially around the perimeter of said main frame and spaced outwardly therefrom, said release means adapted to operably engage a part of said subframe.

* * * * *

UNITED STATES PATENT AND TRADEMARK OFFICE

CERTIFICATE OF CORRECTION

PATENT NO. : 5,239,923

DATED : August 31, 1993

INVENTOR(S) : JAMES E. BELCHER and JOHN R. COULTER

It is certified that error appears in the above-indentified patent and that said Letters Patent is hereby corrected as shown below:

Column 11, line 29;

"31" should be --314--.

Signed and Sealed this

Nineteenth Day of July, 1994

Bruce Lehman

*Attest:*

BRUCE LEHMAN

*Attesting Officer*

*Commissioner of Patents and Trademarks*